US008660703B2

(12) United States Patent
Beraud et al.

(10) Patent No.: US 8,660,703 B2
(45) Date of Patent: Feb. 25, 2014

(54) METHOD AND DEVICE FOR CONTROLLING A WASTEWATER NETWORK

(75) Inventors: Benoit Beraud, La Garenne Colombes (FR); Maurin Lovera, Indianapolis, IN (US); Mohammad Mourad, Paris (FR)

(73) Assignee: Veolia EAU—Compagnie Generale des Eaux, Paris (FR)

( * ) Notice: Subject to any disclaimer, the term of this patent is extended or adjusted under 35 U.S.C. 154(b) by 386 days.

(21) Appl. No.: 13/013,951

(22) Filed: Jan. 26, 2011

(65) Prior Publication Data

US 2012/0065786 A1 Mar. 15, 2012

(30) Foreign Application Priority Data

Sep. 13, 2010 (FR) ..... 10 57272

(51) Int. Cl.
*G05D 7/06* (2006.01)

(52) U.S. Cl.
USPC ..... 700/282; 702/3; 702/50; 73/195

(58) Field of Classification Search
USPC ..... 700/282; 702/50, 3; 73/195
See application file for complete search history.

(56) References Cited

U.S. PATENT DOCUMENTS

| | | | | |
|---|---|---|---|---|
| 2002/0170350 | A1* | 11/2002 | Schutzbach | 73/195 |
| 2007/0021936 | A1 | 1/2007 | Marovitz | |
| 2009/0230033 | A1* | 9/2009 | Bowers, Jr. | 210/85 |

FOREIGN PATENT DOCUMENTS

| | | |
|---|---|---|
| DE | 4016373 | 11/1991 |
| WO | 02095149 | 11/2002 |

OTHER PUBLICATIONS

Schutze et al.; "Real time control of urban wastewater systems—where do we stand today?"; Journal of Hydrology, 299 (2004) 335-348.

Beraud et al.; "Optimisation of sewer networks hydraulic behaviour during wet weather: coupling genetic algorithms with two sewer networks modelling tools"; Novatech 2010; pp. 1-10.

* cited by examiner

*Primary Examiner* — Tejal Gami
(74) *Attorney, Agent, or Firm* — Coats and Bennett PLLC

(57) ABSTRACT

A control method for controlling a wastewater network, said network including actuators suitable for influencing the flow rates of water in the network, with the behavior of the actuator depending on setpoints, the method comprising:

a step of selecting a rain type from a list of predetermined rain types, as a function of forecast or measured rain;

a step of selecting a set of setpoints from a list of predetermined setpoints, as a function of the selected rain type; and a step of sending the setpoints of the selected set of setpoints to said actuators.

The method further comprises a step of obtaining first state information representative of the current state of the network, said set of setpoints being selected from the list of predetermined sets of setpoints as a function of the selected rain type and as a function of the first state information.

11 Claims, 3 Drawing Sheets

METHOD AND DEVICE FOR CONTROLLING A WASTEWATER NETWORK

BACKGROUND OF THE INVENTION

The invention relates to the general field of wastewater networks. The invention relates in particular to real time management of such a network.

A wastewater network typically comprises water transport works, e.g. pipes, for conveying water to a treatment plant, and storage works, such as storm-water tanks. The network may also include automatic means and actuators such as pumps and valves for influencing the flow of water in the network. For example, a pump may be controlled as a function of the level of water in a tank.

The control setpoints of the actuators influence the performance of the network. For example, a high trigger level for a pump for discharging a storm tank serves to limit the quantity of water that is discharged into the network downstream and thus to limit the risk of flooding or of overflowing into the natural environment from the network downstream. Nevertheless, such a high level also puts a limit on the quantity of water that can still be stored in the event of heavy rain. The risk of overflowing into the natural environment upstream from the storm tank is thus increased.

Real time management of a wastewater network consists in adapting the setpoints for controlling the actuators to a rain event, so as to improve the performance of the network. By way of example, network performance may be characterized by the locations of floods in built-up areas and by the quantity of water that overflows into the natural environment, or indeed the quantity of energy that is used while performing said management. Thus, it is known to adapt control setpoints for actuators to match rain as forecast or measured.

For example, the Seine-Saint-Denis drainage network as described in the document "Exploitation en temps réel du réseau d'assainissement de Seine-Saint-Denis" [Real time operation of the Seine-Saint-Denis drainage network] by J. M. Delattre, as given to the Congress "La gestion avanzada del drenaje urbano" [Advanced management of urban drainage], Barcelona, 2004, is based on a scenario approach. In that approach, a rain type approximating as closely as possible to present or future real rain over the territory is selected from a sample of 27 rain types. Each rain type corresponds to a set of setpoints for actuators of the network. The sets of setpoints were predetermined, by using a model of the network.

It is also known to use an optimization algorithm to predetermine an optimum set of setpoints for a given rain type, as a function of the network model. Thus, the document "Optimization of sewer networks hydraulic behavior during wet weather: coupling genetic algorithms with two sewer networks modeling tools" presented at the Novatech 2010 Congress at Lyon, shows that such optimization makes it possible to improve the performance of real time management compared with predetermined setpoints derived from the long experience of the network manager.

OBJECT AND SUMMARY OF THE INVENTION

A wastewater network may comprise numerous works and actuators. The inventors have found that in practice, a network nearly always includes at least one work or actuator that is not available or that is operating at reduced capacity. Non-availability may be due, for example, to a fault or to being laid up for maintenance purposes. Unfortunately, in the prior art mentioned in the introduction, the sets of setpoints are predetermined as a function of a model of the network that represents the nominal state of the network. Thus, the setpoints used can lead to underperformance of the network when its state is not the nominal state.

The invention seeks to provide a wastewater network control method that presents improved performance. In particular, the invention seeks to use a set of setpoints that leads to improved performance.

To this end, the invention provides a control method for controlling a wastewater network, said network including actuators suitable for influencing the flow rates of water in the network, with the behavior of the actuator depending on setpoints, the method comprising:

- a step of selecting a rain type from a list of predetermined rain types, as a function of forecast or measured rain;
- a step of selecting a set of setpoints from a list of predetermined setpoints, as a function of the selected rain type; and
- a step of sending the setpoints of the selected set of setpoints to said actuators;

wherein the method further comprises a step of obtaining first state information representative of a current state of the network, said set of setpoints being selected from the list of predetermined sets of setpoints as a function of the selected rain type and as a function of the first state information;

the control method further comprising:

- a step of obtaining second state information representative of a current or forecast state of the network;
- a step of determining at least one new set of setpoints as a function of a model of the network and as a function of the second state information; and
- a step of adding said new set of setpoints to said list of sets of setpoints.

By means of the invention, the set of setpoints is selected not only as a function of rain type, but also as a function of the current state of the network. It is thus possible to select a set of setpoints that enables improved performance to be obtained, given the current state of the network. Furthermore, when a change of state is planned or detected, a corresponding new set of setpoints is added to the list. Thus, the list of sets of setpoints contains a set of setpoints that enables improved performance to be obtained, regardless of the state of the network.

In an implementation, the step of determining at least one new set of setpoints comprises determining a new set of setpoints for each rain type in the list of rain types.

The step of determining at least one new set of setpoints may comprise executing an optimization algorithm.

Said step of determining at least one new set of setpoints comprises determining a model of the network as a function of a nominal network model and as a function of the second state information. In other words, the network model that is used is an updated model.

In an implementation, the control method comprises:

- a step of evaluating the real performance of the network during a rain event;
- a step of evaluating the simulated performance of the network as a function of a rain hyetograph (storm intensity pattern) of the rain event and as a function of the set of setpoints selected during the rain event; and
- a step of comparing said real and simulated performance evaluations.

In an implementation, the control method comprises:

- a step of evaluating first simulated performance of the network as a function of a rain hyetograph of the rain event and as a function of the set of setpoints selected during the rain event;

a step of evaluating second simulated performance of the network as a function of said rain hyetograph and as a function of a set of setpoints selected as a function of said rain hyetograph; and a step of comparing said first and second simulated performance evaluations.

In an implementation, the control method comprises:

a step of evaluating optimum performance of the network during a rain event;

a step of evaluating simulated performance of the network as a function of a rain hyetograph of the rain event and as a function of a set of setpoints selected as a function of said rain hyetograph; and a step of comparing said optimum and simulated performance evaluations.

In corresponding manner, the invention also provides a control device for a wastewater network, said network including actuators suitable for influencing the water flow rates in the network, the behavior of the actuators depending on setpoints, the control device comprising:

selector means for selecting a rain type from a list of predetermined rain types as a function of forecast or measured rain;

selector means for selecting a set of setpoints from a list of predetermined sets of setpoints as a function of the selected rain type; and means for sending the setpoints of the selected set of setpoints to said actuators;

wherein the control device further comprises:

means for obtaining first state information representative of a current state of the network, said set of setpoints being selected from the list of predetermined sets of setpoints as a function of the selected rain type and as a function of the first state information;

means for obtaining second state information representative of a current or forecast state of the network;

means for determining at least one new set of setpoints as a function of a model of the network and as a function of the second state information; and means for adding said new set of setpoints to said list of sets of setpoints.

The invention also provides a wastewater network including actuators suitable for influencing the water flow rates in the network, the behavior of the actuators depending on setpoints, the network further including a control device of the invention.

The invention also provides a computer program including instructions for executing the steps of the above-mentioned control method when said program is executed by a computer.

The program may use any programming language, and it may be in the form of source code, object code, or code that is intermediate between source code and object code, e.g. in a partially compiled form, or in any other desirable form.

The invention also provides a recording medium or data medium that is readable by a computer and that includes instructions of a computer program as mentioned above.

The above-mentioned recording media may be any kind of entity or device capable of storing the program. For example, the medium may comprise storage means such as a read-only memory (ROM), e.g. a compact disk (CD) ROM, or a microelectronic circuit ROM, or indeed magnetic recording means, e.g. a floppy disk or a hard disk.

Furthermore, the recording media may correspond to a transmissible medium such as an electrical or an optical signal, which may be conveyed via an electrical or optical cable, by radio, or by other means. The program of the invention may in particular be downloaded from an Internet type network.

Alternatively, the recording media may correspond to an integrated circuit in which the program is incorporated, the circuit being adapted to execute or to be used in the execution of the method in question.

BRIEF DESCRIPTION OF THE DRAWINGS

Other characteristics and advantages of the present invention appear from the following description given with reference to the accompanying drawings that show an implementation having no limiting character. In the figures.

DETAILED DESCRIPTION OF EMBODIMENTS

Figure 1:
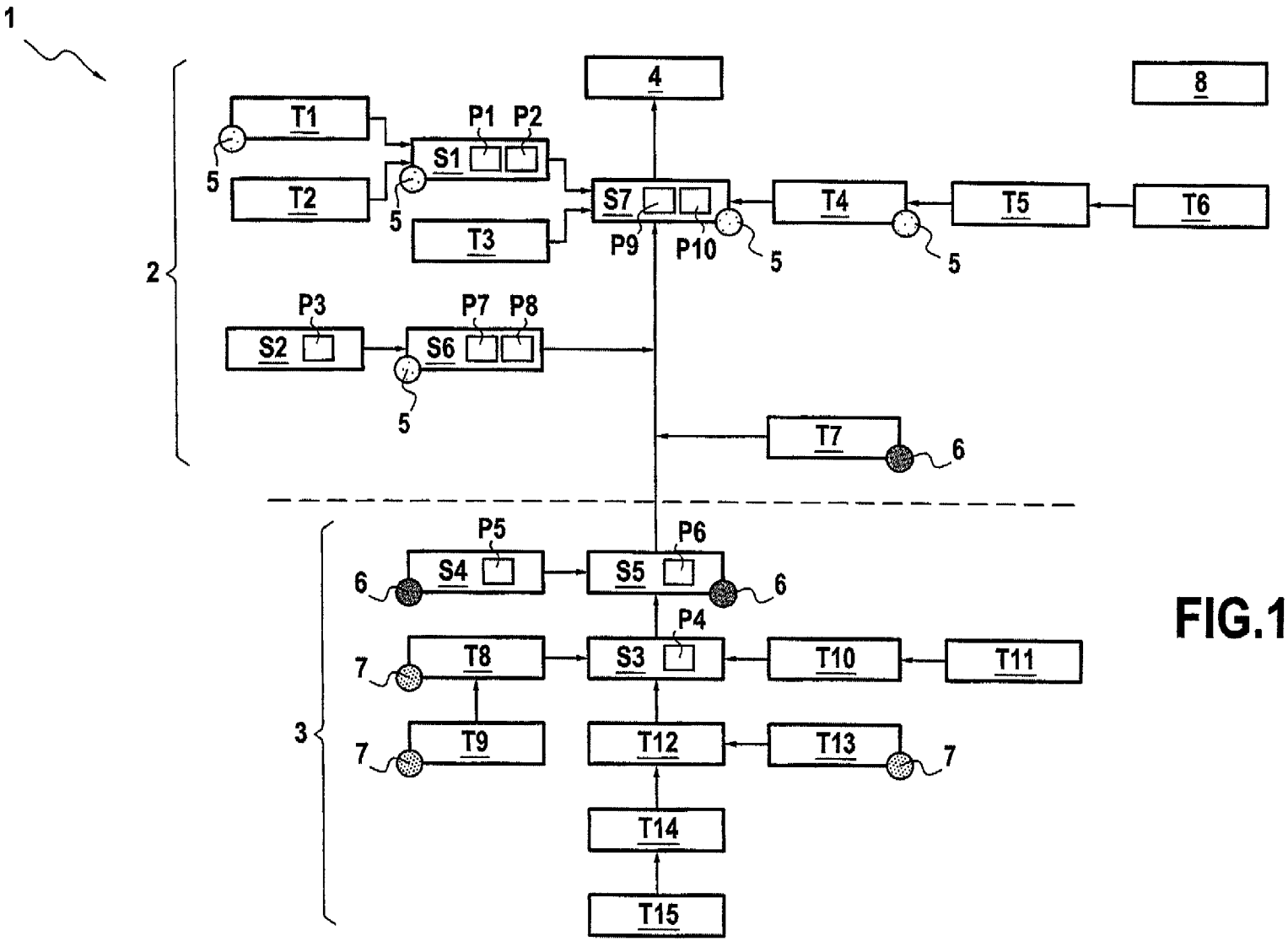
FIG. 1 shows a wastewater network suitable for performing a control method in an implementation of the invention.

FIG. 1 shows a wastewater network 1 for conveying rainwater from a built-up area to a treatment plant 4. The built-up area comprises a north zone 2 and a south zone 3.

In this example, the network 1 has tanks S1 to S7, pumps P1 to P10, buffers T1 to T15, pipes represented by arrows, and a control device 8. Each tank S1 to S7 also has a level sensor serving to measure the depth of water h in the tank.

Circles 5, 6, and 7 represent overflow points to the natural environment, respectively into a first water course A5, a second water course A6, and a third water course A7.

Figure 2:
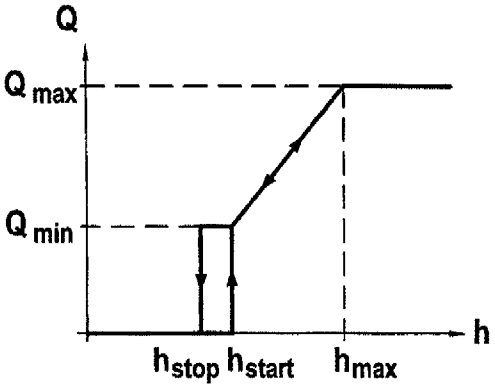
FIG. 2 shows a control relationship for a pump of the FIG. 1 network.

FIG. 2 is a graph showing the behavior of the pumps P1 to P10 of the network 1. The flow rate Q of a pump is controlled as a function of the depth h of water in the associated tank, as measured by a sensor. Thus, if the depth h is less than $h_{stop}$, the pump is stopped. The water level will then rise until it reaches $h_{start}$. The pump is then put into operation at a flow rate $Q_{min}$. There are then two possibilities. If the weather is dry, the wastewater flow rate coming into the tank is less than $Q_{min}$ and the water level will drop until it reaches $h_{stop}$, thereby causing the pump to be stopped. If the weather is rainy and the wastewater flow rate is greater than $Q_{min}$ then the water level will continue to rise and the pump will then increase its flow rate until it stabilizes at the flow rate of the incoming water, or until it reaches its maximum flow rate $Q_{max}$.

If the flow rate of water entering the tank is greater than $Q_{max}$, the water level will continue to rise and the water might overflow into the natural environment, which ought to be avoided.

The depth of water $h_{max}$ at which the pump reaches it maximum flow rate $Q_{max}$ constitutes a control setpoint that is representative of the tendency to store water in the tank (if $h_{max}$ is high) or to pump it rapidly downstream in order to avoid storing it (if $h_{max}$ is low). For each of the pumps P1 to P10, the value of $h_{max}$ influences the performance of the network. A high value of $h_{max}$ serves to limit the quantity of water that is discharged into the downstream network and thus to limit the risk of flooding in the downstream network. Nevertheless, a high value for $h_{max}$ also limits the quantity of water that can still be stored in the event of heavy rain. The risk of overflowing into the natural environment is thus increased.

Thus, the control setpoints $h_{max}$ for each of the pumps P1 to P10 needs to be selected in appropriate manner.

Figure 3:
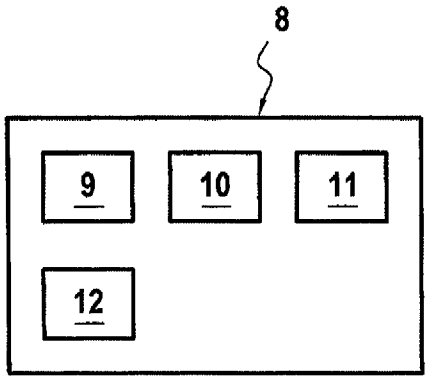
FIG. 3 shows a control device of the FIG. 1 network.

By way of example, the control device 8 is situated in control premises of the manager of the network 1. FIG. 3 shows the control device 8 in greater detail. It presents the architecture of a computer and comprises in particular a processor 9, a non-volatile memory 10, a random access memory (RAM) 11, and a communications interface 12. The processor 9 is capable of executing a program for controlling the network 1, which program is stored in the memory 10, with execution thereof making use of the RAM 11. Thus, the memory 10 constitutes a data medium in the meaning of the invention and the control device 8 constitutes a control device in the meaning of the invention.

The control device 8 stores in the memory 10 a list of rain types, a list of network states, and a plurality of sets of setpoints for the pumps P1 to P10. For example, the list of rain types comprises uniform rain referenced "PLHO", and heavier rain in the south zone 3, referenced "PLFS". The list of network states includes a nominal state EN in which the tanks S1 to S7, the pumps P1 to P10, the buffers T1 to T15, and the pipes of the network 1 are all operating normally, and a first laid-up state EC1 in which action on the network requires the flow rate $Q_{max}$ of the pumps P1 to P2 to be limited to half their nominal $Q_{max}$ flow rate.

The list of sets of setpoints includes a set of setpoints that is associated with each rain type and network state pair, as represented by Table 1 in which C1 to C4 represents the sets of setpoints.

TABLE 1

| | PLHO | PLFS |
|---|---|---|
| EN | C1 | C2 |
| EC1 | C3 | C4 |

The sets of setpoints C1 to C4 are predetermined in a manner that is described below.

Figure 4:
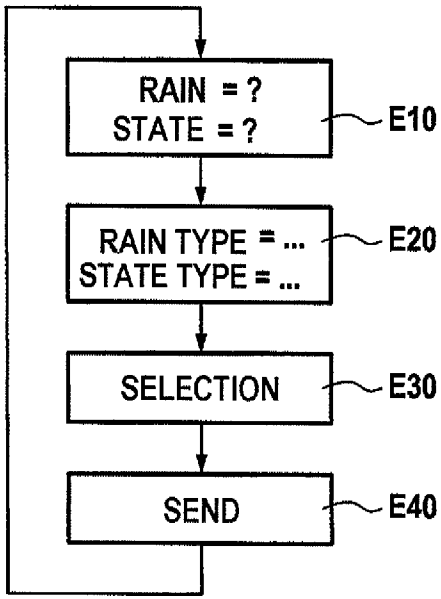
FIG. 4 shows steps in a control method implemented by the control device of FIG. 3.

FIG. 4 shows the steps of the control method implemented by the control device 8.

In step E10, the control device 8 obtains information about current or forecast rain over the built-up area, e.g. from a weather station. The control device 8 also obtains information representative of the current state of the network 1, e.g. by consulting a system for planning maintenance actions on the network or by consulting sensors suitable for generating such information, e.g. a pump fault sensor.

Thereafter, in step E20, the control station 8 selects, from the list of rain types, the rain type that corresponds most closely to the rain determined in step E10. From the list of network states, the control station 8 also selects the state that corresponds most closely to the state determined in step E10.

Thereafter, in step E30, the control device 8 selects from the list of sets of setpoints, the set of setpoints that corresponds to the rain type and to the network state as selected in step E20. For example, if PLSF rain and the EN nominal state were selected in step E20, then the control device 8 selects the C2 set of setpoints in step 30.

Finally, in step E40, the control device 8 sends messages to the pumps P1 to P10 informing them of the setpoints to be used, i.e. the setpoints of the set C2 of setpoints in the above example.

Steps E10 to E40 may be repeated. Thus, in the event of a change in current or forecast rain and/or in the event of a change in the state of the network, step E30 may select a new set of setpoints that is better matched to the conditions. The newly selected set of setpoints then enables the best performance to be obtained from the network, given the present or forecast rain and the state of the network.

Figure 5:
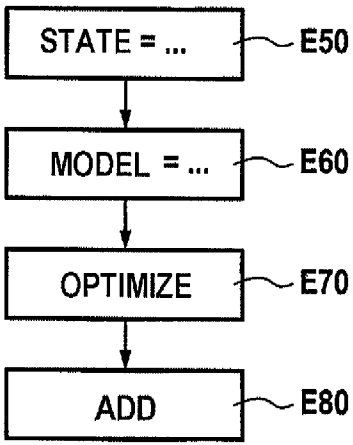
FIG. 5 shows other steps of a control method implemented by the control device of FIG. 3.

FIG. 5 shows other steps of the control method implemented by the control device 8.

In step E50, the control device obtains state information representative of the current or forecast state of the network, referred to as state EC2. By way of example, the state information may indicate that such-and-such a work is laid up or operating at reduced capacity. To obtain this state information, the control device 8 may consult a system for planning action on the network or sensors suitable for generating such information, as in step E10. It is assumed in this example that none of the states EN and EC1 in the predetermined list of states corresponds to the state information that is obtained. The state EC2 is thus a new state for the network.

Thereafter, in step E60, the control device 8 determines an updated model of the network 1. For this purpose, the control device 8 updates a nominal model of the network 1, e.g. stored in the memory 10, as a function of the state information obtained in step E50. Thus, the updated model of the network 1 reflects the current or forecast state EC2 of the network.

After determining the updated model, the control device 8 acts in step E70 to determine a set of setpoints for each rain type in the list of rain types, by using the updated model. Thus, a set C5 of setpoints is determined for rain PLHO and state EC2 and a set C6 of setpoints is determined for rain PLFS and state EC2. For this purpose, the control device 8 implements an optimization algorithm in order to determine the set of setpoints that optimizes the performance of the network 1 for given rain and using the updated model. By way of example, the optimization algorithm may be implemented in the manner described in the document mentioned in the introduction.

For the requirements of the optimization algorithm, the performance of the network 1 may be represented by a performance function that is defined by the manager of the network 1. For example, if the object of the manager is to minimize the amount of water discharged from the network 1 into the above-mentioned water courses A5, A6, and A7, and if the water course A5 is considered as being more critical than the water course A6, which is itself considered as being more critical than the water course A7, then the performance function may be $$FP=3VA5+2VA6+VA7$$

where VA5, VA6, and VA7 represent the volumes discharged into the water courses A5, A6, and A7, respectively. The optimization algorithm then provides a set of setpoints that minimizes the performance function FP.

In a variant, the optimization algorithm may be a multi-target optimization algorithm that provides a plurality of solutions minimizing the volumes VA5, VA6, and VA7, followed by making a selection amongst the solutions that have been found as a function of the relative degrees of criticality of the water courses.

The optimization algorithm may take account of constraints, e.g. of limits between which it must find the setpoints that are to be optimized.

The above-mentioned sets C1 to C4 of setpoints are predetermined in similar manner, using the optimization algorithm and the nominal model of the network 1 (sets C1 and C2) or a model that is updated as a function of the state EC1 (sets C3 and C4).

In step E80, the sets C5 and C6 are added to the list of sets of setpoints, in correspondence with the rain types PLHO and PLFS, and in correspondence with the network state EC2.

Thus, after performing steps E50 to E80, the list of sets of setpoints comprises a set of setpoints that is associated with each rain type and network state pair, including for the state EC2 of step E50, as shown in Table 2.

TABLE 2

| | PLHO | PLFS |
|---|---|---|
| EN | C1 | C2 |
| EC1 | C3 | C4 |
| EC2 | C5 | C6 |

In a variant, step E80 is preceded by a step (not shown) of an operator validating the sets C5 and C6 of setpoints.

Also in a variant, the optimization of step E70 applies only to some of the setpoints of the network 1.

For example, the $h_{max}$ setpoints of the pumps P9 and P10 that are connected directly to the treatment plant 4 may be deemed to be too critical to be subjected to optimization. Thus, the optimization algorithm applies only to the $h_{max}$ setpoints of the other pumps P1 to P8.

By way of example, the steps of FIG. 5 are executed periodically or in response to an instruction input by an operator. The steps of FIG. 5, may also be executed when the control device 8 detects, in step E10, a network state that does not correspond to any of the states in the list of predetermined states.

By means of steps E50 to E80, when a new state of the network 1 is provided or detected, new sets of setpoints corresponding thereto are added to the list. Thus, the list of sets of setpoints contains sets of setpoints that serve to obtain improved performance, whatever the state of the network.

Figure 6:
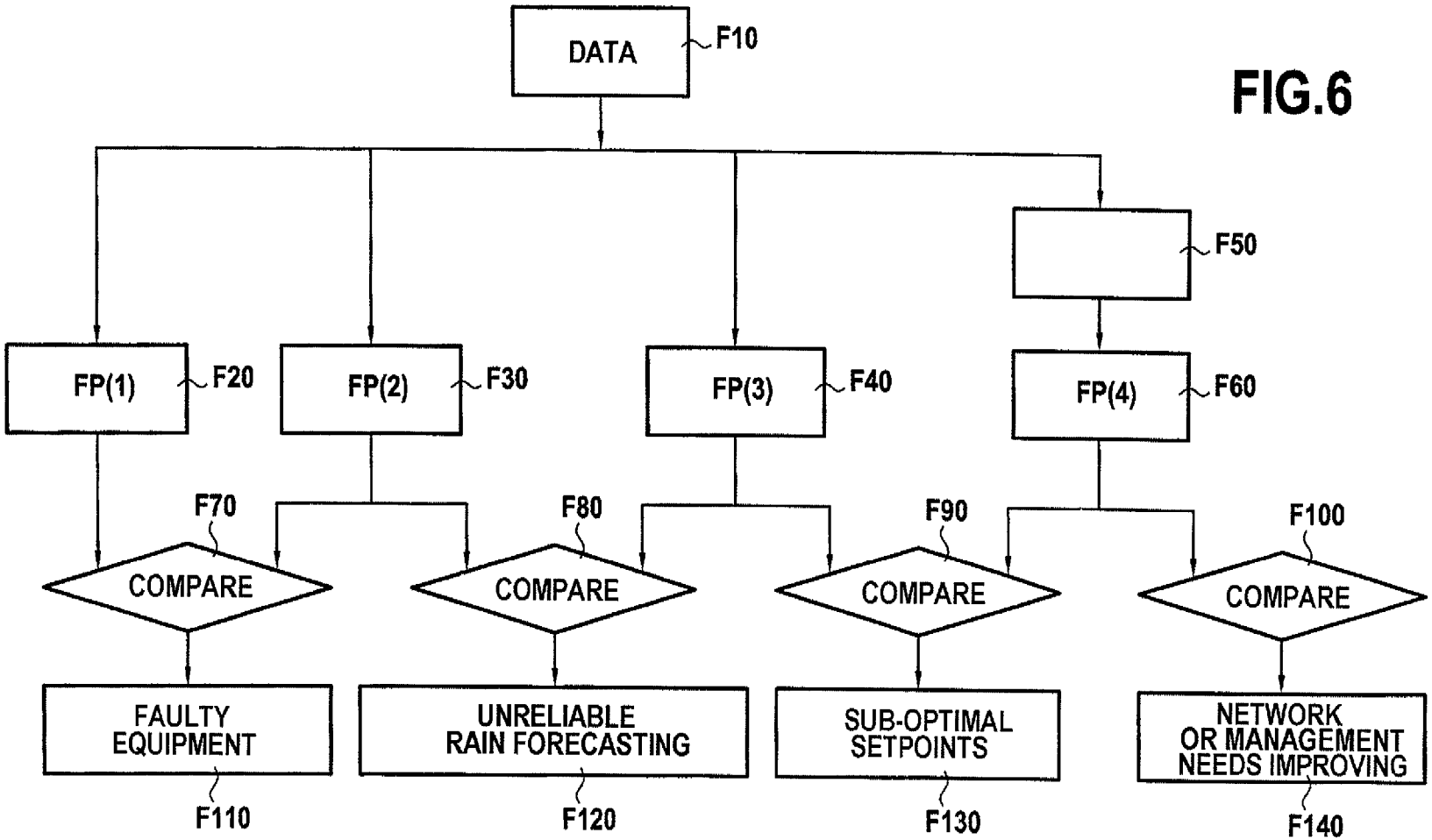
FIG. 6 shows other steps of a control method implemented by the control device of FIG. 3.

FIG. 6 shows other steps of the control method implemented by the control device 8. The steps of FIG. 6 are executed after a significant rain event.

In step F10, the control device 8 obtains data representative of the operation of the network 1 during the rain event. By way of example, this data comprises the water levels in the tanks S1 to S7, the flow rates of the pumps P1 to P10, and the discharge volumes or flow rates A5 to A6. The control device 8 also obtains data representative of the rain that has actually fallen, e.g. a rain hyetograph as measured during the rain event. Finally, the control device 8 is aware of the set of setpoints that has been selected for the rain event, and also of the selected rain type and the selected network state corresponding thereto.

Thereafter, in steps F20 to F60, the control device 8 evaluates different values of the performance function FP of the network 1.

More precisely, in step F20, the control device 8 evaluates the real performance FP(1) of the network 1. For this purpose, the value FP(1) is calculated as a function of data representative of the operation of the network 1 during the rain event, as obtained in step F10.

In step F30, the control device 8 evaluates the simulated performance FP(2) of the network 1 without reclassifying the rain. Thus, the control device 8 calculates the value FP(2) as a function of the rain hyetograph obtained in step F10 and of the set of setpoints being used during the rain event.

In step F40, the control device 8 evaluates the simulated performance FP(3) of the network 1 after reclassifying the rain. Thus, the control device 8 calculates the value FP(3) as a function of the rain hyetograph obtained in step F10 and of a set of setpoints corresponding to the rain type that ought have been selected from the list of rain types, given the rain that actually fell.

Finally, in step F50, the control device 8 determines an optimum set of setpoints for the rain that actually fell, and then in step F60 it evaluates the simulated optimum performance FP(4) of the network 1. Thus, the control device 8 calculates the value FP(4) as a function of the rain hyetograph obtained in step F10 and as a function of the optimum set of setpoints as determined in step F50.

During steps F30 to F60, the model of the network 1 that is used is the model that has been updated as a function of the network state selected for the rain event.

Thereafter, during steps F70 to F100, the values FP(1) to FP(4) are compared, and then in steps F110 to F140, conclusions are drawn as a function of those comparisons.

More precisely, in step F70, FP(1) is compared with FP(2). If a significant difference is observed, that means that equipment in the network 1 is faulty. Thus, in step F110, a comparison between the measured and simulated flow rates and levels serves to identify the faulty equipment. For example, if the measured flow rate of a pump levels out at a given level below the simulated flow rate for that pump, that means that the pump is faulty. The control device 8 can then display a maintenance recommendation concerning that pump for use by the manager of the network 1.

In step F80, FP(2) is compared with FP(3). If a considerable difference is observed, that means that the rain type selected for the rain event was remote from the rain that actually fell. In other words, rain detection and forecasting need to be improved so as to enable rain type selection to be performed better. Thus, in step F120, the control device 8 displays a recommendation to improve the detection and the forecasting of rain.

In step F90, FP(3) is compared with FP(4). If a significant difference is observed, that means that the set of setpoints that was selected for the rain event was suboptimal. Thus, in step F130, the control device 8 displays a recommendation to add a new rain type to the list of rain types, together with the corresponding optimum setpoints. Thus, if the recommendation is accepted (e.g. by an operator), then the control device 8 determines for the new rain type and for each network state in the list of network states, a new set of setpoints. For this purpose, the control device 8 implements an optimization algorithm, as explained above with reference to step E70.

For the above-mentioned steps F70 to F90, a difference is said to be significant for example if the difference is greater than a predetermined threshold.

Finally, in step F100, FP(4), which represents the optimized performance of the network 1 for the rain that fell, is compared with a performance threshold. If the optimized performance is found to be insufficient, then in step F140 the control device 8 displays a recommendation to investigate improving the structure of the network 1 or improving its real-time management.

Thus, after a rain event, the steps of FIG. 6 enable the causes of possible underperformance of the network 1 to be diagnosed and they indicate leads for studying for improvement.

The invention is described above with reference to an implementation in which the actuators of the network are pumps and the control setpoints are depths $h_{max}$. Naturally, the invention may be applied to other types of actuator, e.g.

valves, and to other types of control setpoints. The control relationship for the pumps may be other than that shown in FIG. 2.

In a variant, the list of network states initially comprises only the nominal state EN. The steps shown in FIG. 5 then enable one or more additional states to be added, as necessary.

Also in a variant, the list of rain types may initially be empty. Under such circumstances, the control device 8 possess sufficient computation power to implement the optimization algorithm in the time interval between rain being forecast and the actual appearance of that rain, with it being possible for a first rain type corresponding to the forecast rain to be added to the list of rain types together with the set of setpoints determined therefor, before the rain appears. The determined setpoints can then be applied.

What is claimed is:

1. A control method for controlling a wastewater network, said network including actuators suitable for influencing the flow rates of water in the network, with the behavior of the actuator depending on setpoints, the method comprising:

creating a list of one or more network states, said list comprising an initial network state;

creating a list of predetermined rain types and a list of predetermined sets of setpoints;

obtaining rain state information representative of forecast or measured rain;

selecting a rain type from the list of predetermined rain types as a function of forecast or measured rain;

selecting a set of setpoints from the list of predetermined sets of setpoints, as a function of the selected rain type;

sending the selected set of setpoints to said actuators;

obtaining network state information representative of a current or forecast state of the network;

if none of the network states in the list of one or more network states corresponds to the network state information, determining at least one new set of setpoints as a function of a model of the network and as a function of the network state information; and adding said new set of setpoints to said list of sets of setpoints.

2. A control method according to claim 1, wherein said step of determining at least one new set of setpoints comprises determining a new set of setpoints for each rain type in the list of rain types.

3. A control method according to claim 1, wherein said step of determining at least one new set of setpoints comprises executing an optimization algorithm.

4. A control method according to claim 1, wherein said step of determining at least one new set of setpoints comprises determining a model of the network as a function of a nominal network model and as a function of the network state information.

5. A control method according to claim 1, comprising:

a step of evaluating the real performance of the network during a rain event;

a step of evaluating the simulated performance of the network as a function of a rain hyetograph of the rain event and as a function of the set of setpoints selected during the rain event; and a step of comparing said real and simulated performance evaluations.

6. A control method according to claim 1, further comprising:

a step of evaluating first simulated performance of the network as a function of a rain hyetograph of the rain event and as a function of the set of setpoints selected during the rain event;

a step of evaluating second simulated performance of the network as a function of said rain hyetograph and as a function of a set of setpoints selected as a function of said rain hyetograph; and a step of comparing said first and second simulated performance evaluations.

7. A control method according to claim 1, comprising:

a step of evaluating optimum performance of the network during a rain event;

a step of evaluating simulated performance of the network as a function of a rain hyetograph of the rain event and as a function of a set of setpoints selected as a function of said rain hyetograph; and a step of comparing said optimum and simulated performance evaluations.

8. A computer program including instructions for executing the steps of the control method according to claim 1 when said program is executed by a computer.

9. A non-transitory data medium readable by a computer and including instructions of a computer program according to claim 8.

10. A control device for a wastewater network, said network including actuators suitable for influencing the water flow rates in the network, the behavior of the actuators depending on setpoints, the control device configured to:

store a list of one or more network states, said list comprising an initial network state;

store a list of predetermined rain types and a list of predetermined sets of setpoints;

obtain rain state information representative of forecast or measured rain;

select a rain type from a list of predetermined rain types as a function of forecast or measured rain;

select a set of setpoints from the list of predetermined sets of setpoints as a function of the selected rain type;

send the selected set of setpoints to said actuators;

obtain network state information representative of a current or forecast state of the network;

determine at least one new set of setpoints as a function of a model of the network and as a function of the network state information if none of the network states in the list of one or more network states corresponds to the network state information; and add said new set of setpoints to said list of sets of setpoints.

11. A wastewater network including actuators suitable for influencing the water flow rates in the network, the behavior of the actuators depending on setpoints, the network further including a control device according to claim 10.

* * * * *